US005769149A

United States Patent [19]

Mertens

[11] Patent Number: 5,769,149

[45] Date of Patent: Jun. 23, 1998

[54] PLANT FOR PRODUCING HOT-ROLLED STEEL STRIP

[75] Inventor: Werner Mertens, Viersen, Germany

[73] Assignee: SMS Schloemann-Siemag Aktiengesellschaft, Dusseldorf, Germany

[21] Appl. No.: 673,803

[22] Filed: Jun. 27, 1996

[30] Foreign Application Priority Data

Jul. 1, 1995 [DE] Germany ..... 195 24 082.0

[51] Int. Cl.[6] ..... B22D 11/12; B21B 1/46

[52] U.S. Cl. ..... 164/418; 29/33 C

[58] Field of Search ..... 164/418, 476; 29/527.7, 33 C

[56] References Cited

U.S. PATENT DOCUMENTS

| | | | |
|---|---|---|---|
| 5,467,518 | 11/1995 | Mertens | 29/527.7 |
| 5,472,041 | 12/1995 | Cryderman et al. | 164/476 |
| 5,601,137 | 2/1997 | Abe et al. | 164/476 |

FOREIGN PATENT DOCUMENTS

| | | |
|---|---|---|
| 0327854 | 4/1992 | European Pat. Off. . |
| 4137547 | 11/1993 | Germany . |

*Primary Examiner*—Joseph J. Hail, III
*Assistant Examiner*—I.-H. Lin
*Attorney, Agent, or Firm*—Friedrich Kueffner

[57] ABSTRACT

A plant for producing hot-rolled steel strip in a production line includes a continuous slab casting plant, transverse cutting shears, a continuous furnace and a hot-rolling train. The continuous furnace includes a first stationary section and a second section formed with two moveable furnaces, wherein the moveable furnaces can be moved transversely between the production line and a lateral holding position. The length of the first furnace section corresponds to at least the length of the distance which is travelled at casting speed by the newly formed front end of the cast slab by transverse cutting from the transverse cutting unit to a point in front of that moveable furnace which is located in the production line after the exchange of moveable furnaces has been carried out.

3 Claims, 2 Drawing Sheets

PLANT FOR PRODUCING HOT-ROLLED STEEL STRIP

BACKGROUND OF THE INVENTION

1. Field of the Invention

The present invention relates to a plant for producing hot-rolled steel strip in a production line including a continuous slab casting plant, transverse cutting shears, a continuous furnace and a hot-rolling train.

2. Description of the Related Art

In a plant of the above-described type known from EP-B1 03 27 854, a roller conveyer furnace is used for heating and for effecting temperature compensation; the roller conveyer furnace also serves as a buffer area for compensating smaller production interruptions in the area of the rolling mill. This requires a substantial length of the furnace, wherein the length of the furnace essentially determines the distance between the continuous casting plant and the rolling train.

DE-C2 41 37 547 discloses a plant for producing hot-rolled steel strip in which two continuous casting plants are connected to a rolling train through continuous furnaces and a moveable furnace which can be moved between the continuous furnaces. A stationary holding furnace is arranged between the rolling train and the holding station for the moveable furnace arranged in alignment with the rolling train. The furnace sections arranged upstream of the moveable furnaces have a substantially greater length than the moveable furnaces.

SUMMARY OF THE INVENTION

Therefore, it is the primary object of the present invention to provide a plant of the above-described type which, as compared to known plants, has a reduced length of the furnaces and, thus, of the entire plant.

In accordance with the present invention, the continuous furnace includes a first stationary section and a second section formed with two moveable furnaces, wherein the moveable furnaces can be moved transversely between the production line and a lateral holding position.

As a result of this configuration, heating and temperature compensation can take place in the moveable furnaces and another furnace downstream of the moveable furnaces is not required. This results in a reduction of the length of the furnace and the plant. However, because the slab stands still within the moveable furnace, the possible exposure time of the slab is increased.

In order to further reduce the distance between continuous casting plant and rolling train, another feature of the present invention provides that the length of the first furnace section is shorter than the length of the subsequently arranged moveable furnaces.

It is essential that the length of the first furnace section corresponds to at least the length of the distance which is travelled at casting speed by the newly formed front end of the cast slab by transverse cutting from the transverse cutting unit to a point in front of that moveable furnace which is located in the production line after the exchange of moveable furnaces has been carried out.

Consequently, a further reduction of the length of the furnace and plant is achieved.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

DESCRIPTION OF THE PREFERRED EMBODIMENT

Figure 1:
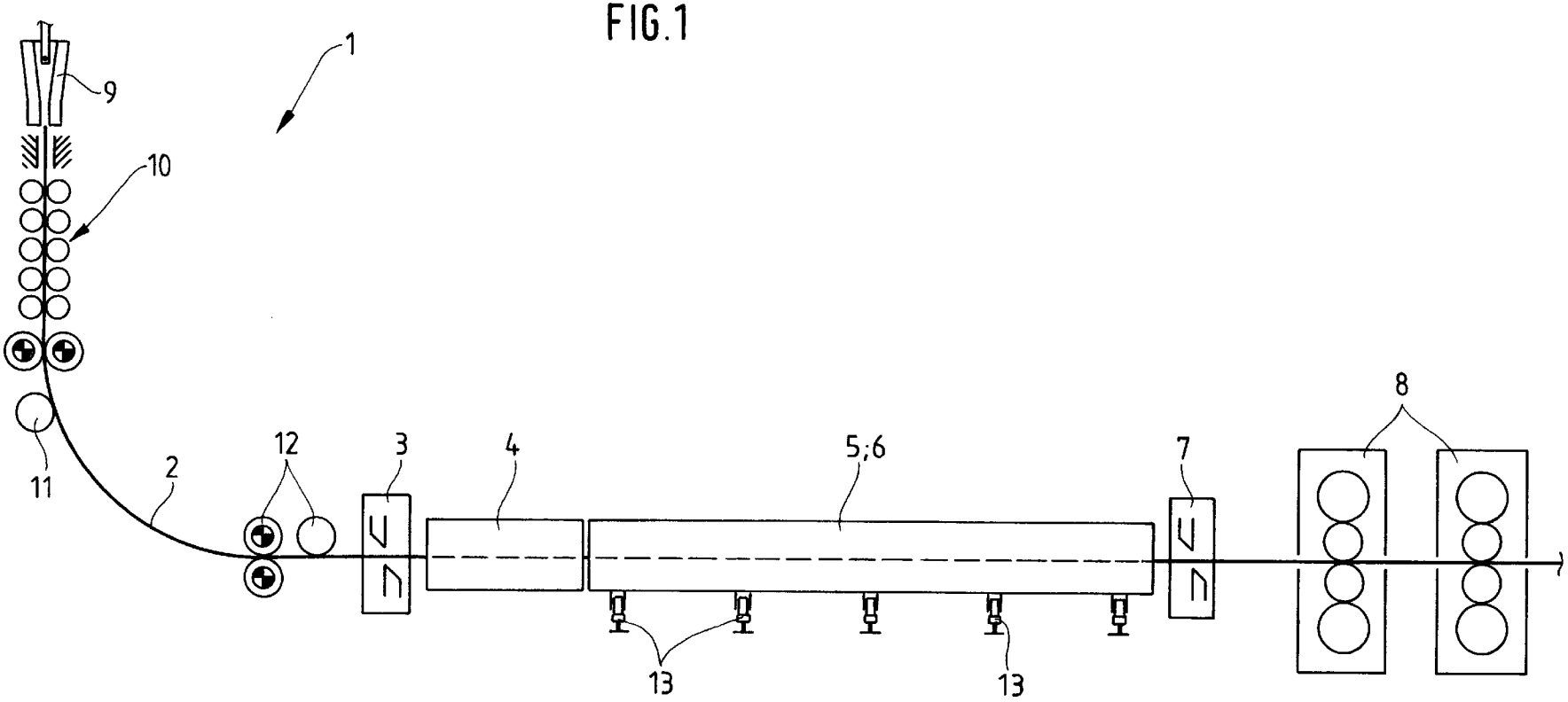
FIG. 1 is a schematic side view of a plant for the production of steel strip.

As illustrated in FIG. 1 of the drawing, a plant for producing steel strip is essentially composed of a continuous casting plant 1 for producing a thin slab strand 2, shears 3, a stationary continuous furnace 4, two moveable furnaces 5, 6, emergency shears 7 and a rolling train 8.

The continuous casting plant 1 includes a mold 9 with subsequently arranged strand guiding means 10, a bending roller 11 and a driving unit 12.

Figure 2:
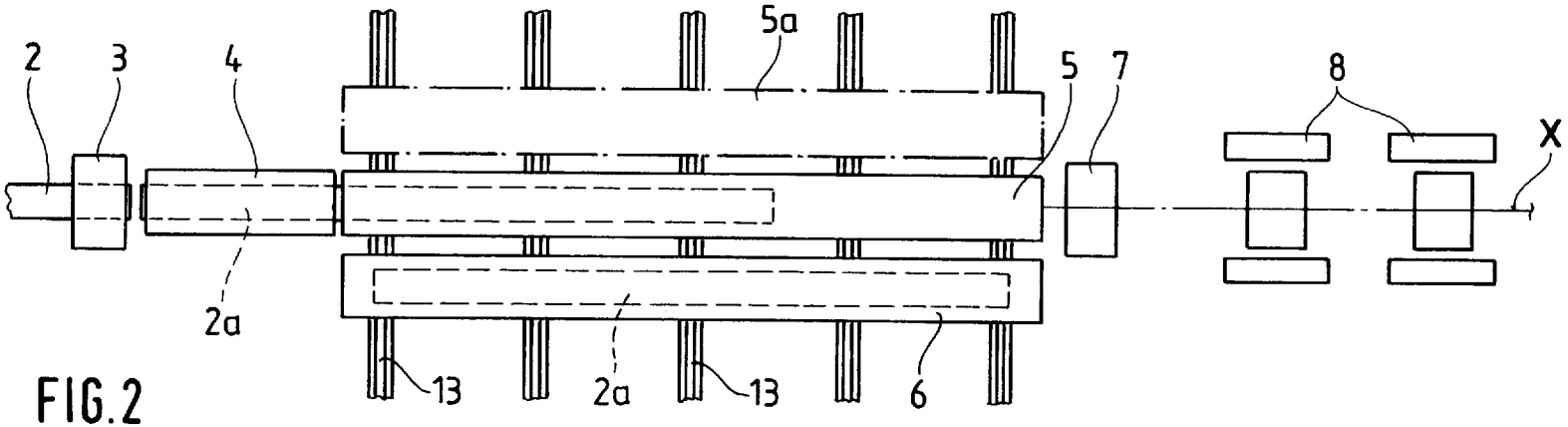
FIG. 2 is a top view showing the furnace area of the plant.

After being deflected into the horizontal, the cast thin slab strand 2 enters the stationary continuous furnace 4 and subsequently enters the moveable furnace 5 situated in the production line X extending between the continuous plant 1 and the rolling train 8. The strand 2 is divided into slab portions 2*a* by means of the shears 3, as schematically shown in FIG. 2.

The stationary continuous furnace 4 has a shorter length than each slab portion 2*a* and each moveable furnace 5, 6. However, the length of the stationary continuous furnace 4 corresponds at least to the distance travelled at casting speed by a newly formed front end of the slab from the shears 3 to an empty moveable furnace 5 located in the production line X after an exchange of moveable furnaces.

Each moveable furnace 5, 6 can be moved on tracks 13 between the production line X and a lateral holding position 5*a* or 6*a*, respectively. This facilitates the following manner of operation.

Figure 3:
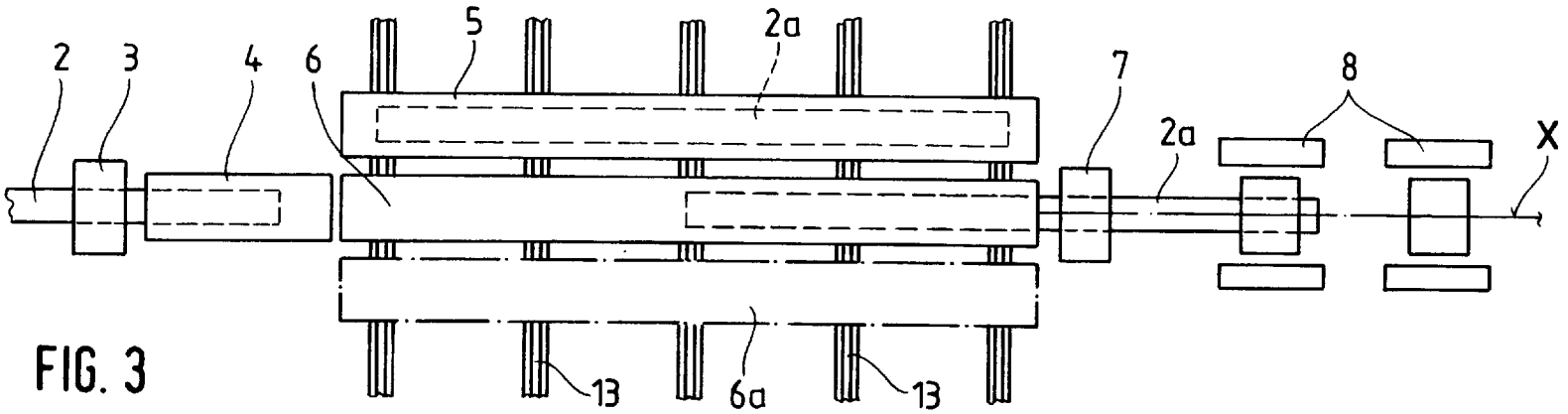
FIG. 3 is a top view, as in FIG. 2, showing the furnace area in a different position of operation.

The strand 2 is conveyed at casting speed through the stationary continuous furnace 4 and into the moveable furnace 5 placed in alignment with the stationary continuous furnace 4. As soon as a slab portion 2*a* has been severed by means of the shears 3, this slab portion 2*a* is conveyed into the moveable furnace 5 in an accelerated manner. Subsequently, the moveable furnace 5 is moved into position 5*a* and the moveable furnace 6 is moved into the production line X. While a slab portion 2*a* which has reached a homogeneous rolling temperature in the moveable furnace 6 is conveyed in an accelerated manner to the rolling train 8 and is pulled in by the rolling train 8, the front end of the strand can enter the moveable furnace 6 as it is being emptied, as illustrated in FIG. 3 of the drawing. Consequently, the stationary continuous furnace 4 must have at least a length which ensures that the front end of the strand 2 reaches the second section of the continuous furnace only when an empty moveable furnace has been moved into the production line X.

While specific embodiments of the invention have been shown and described in detail to illustrate the inventive principles, it will be understood that the invention may be embodied otherwise without departing from such principles.

I claim:

1. A plant for producing hot-rolled steel strip in a production line comprising a continuous slab casting plant, transverse cutting shears, a continuous furnace and a hot finishing rolling train, wherein the continuous furnace comprises a first stationary section and a second section downstream of the first section, the second section comprising two moveable furnaces, the moveable furnaces being transversely moveable such that a first of the moveable furnaces is located in the production line and a second of the moveable furnaces is in a holding position located laterally of the production line.

2. The plant according to claim 1, wherein the first stationary section of the continuous furnace has a length which is smaller than a length of the subsequently arranged moveable furnaces.

3. The plant according to claim 1, wherein the first stationary section of the continuous furnace has a length which is shorter than a slab portion cut by the transverse shears and corresponds at least to a length travelled at casting speed by a newly formed front end of the slab by means of the transverse shears from the transverse shears to an empty moveable furnace located in the production line after an exchange of moveable furnaces.

* * * * *